US008459331B2

(12) United States Patent
Pham et al.

(10) Patent No.: US 8,459,331 B2
(45) Date of Patent: Jun. 11, 2013

(54) VACUUM MOLD

(75) Inventors: Quoc Tran Pham, Anaheim, CA (US); Sean Timothy O'Keeffe, Coto de Caza, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 0 days.

(21) Appl. No.: 13/205,374

(22) Filed: Aug. 8, 2011

(65) Prior Publication Data

US 2013/0037232 A1 Feb. 14, 2013

(51) Int. Cl.
*B22D 18/06* (2006.01)
*B22D 17/22* (2006.01)

(52) U.S. Cl.
USPC ..... 164/61; 164/253; 164/347

(58) Field of Classification Search
USPC ..... 164/61, 253, 254, 131, 344, 347
See application file for complete search history.

(56) References Cited

U.S. PATENT DOCUMENTS

| | | | | |
|---|---|---|---|---|
| 3,123,875 | A * | 3/1964 | Madwed | 164/61 |
| 3,731,727 | A | 5/1973 | Mitamura et al. | |
| 4,254,933 | A | 3/1981 | Netto | |
| 4,586,560 | A * | 5/1986 | Ikeya et al. | 164/457 |
| 5,288,344 | A | 2/1994 | Peker | |
| 5,368,659 | A | 11/1994 | Peker | |
| 5,618,359 | A | 4/1997 | Lin | |
| 5,711,363 | A | 1/1998 | Scruggs et al. | |
| 5,735,975 | A | 4/1998 | Lin | |
| 5,896,642 | A | 4/1999 | Peker | |
| 6,021,840 | A | 2/2000 | Colvin | |
| 6,189,600 | B1 | 2/2001 | Taniguchi et al. | |
| 6,267,170 | B1 | 7/2001 | Onuki | |
| 6,267,171 | B1 | 7/2001 | Onuki | |
| 6,283,197 | B1 | 9/2001 | Kono | |

(Continued)

FOREIGN PATENT DOCUMENTS

| | | |
|---|---|---|
| EP | 0845316 | 6/1998 |
| EP | 1013363 | 6/2000 |

(Continued)

OTHER PUBLICATIONS

Inoue et al., "Bulk amorphous alloys with high mechanical strength and good soft magnetic properties in Fe—Tm—B(TM=IV-VIII group transition metal) system", Appl. Phys. Lett., vol. 71, p. 464 (1997).

(Continued)

*Primary Examiner* — Kevin P Kerns
(74) *Attorney, Agent, or Firm* — Pillsbury Winthrop Shaw Pittman LLP

(57) ABSTRACT

Disclosed is a vacuum mold with at least a first plate and a second plate to mold materials (e.g., amorphous alloys), and a method for manufacturing parts using the mold. An ejector mechanism, to eject molded material, is enclosed within an ejector box that is vacuum sealed relative to the plates. An ejector rod for moving the mechanism is also vacuum sealed via a seal in a vacuum feed through opening. Seals are provided between adjacent interfaces of the mold parts (plates and ejector box) to vacuum seal the mold. The mold is connected to at least one vacuum source that applies vacuum pressure thereto via a first vacuum port in a first direction. A second vacuum port may also be provided to apply pressure in a second direction. A vacuum release valve may be connected to the mold to release vacuum pressure applied to the mold.

34 Claims, 6 Drawing Sheets

U.S. PATENT DOCUMENTS

| | | | | |
|---|---|---|---|---|
| 6,325,868 | B1 | 12/2001 | Kim | |
| 6,371,195 | B1 | 4/2002 | Onuki | |
| 6,427,753 | B1 | 8/2002 | Inoue | |
| 6,460,596 | B1 * | 10/2002 | Yamaguchi et al. | 164/72 |
| 6,875,293 | B2 | 4/2005 | Peker | |
| 6,997,231 | B1 * | 2/2006 | Jung et al. | 164/61 |
| 7,017,645 | B2 | 3/2006 | Johnson et al. | |
| 7,210,517 | B2 * | 5/2007 | Kubota | 164/312 |
| 7,377,303 | B2 * | 5/2008 | Go | 164/61 |
| 7,488,170 | B2 | 2/2009 | Yuasa et al. | |
| 7,708,844 | B2 | 5/2010 | Muramatsu | |
| 7,906,219 | B2 | 3/2011 | Ohara | |
| 2002/0005233 | A1 | 1/2002 | Schirra et al. | |
| 2002/0060059 | A1 * | 5/2002 | Komazaki et al. | 164/113 |
| 2005/0028961 | A1 | 2/2005 | Toyoshima et al. | |
| 2005/0217821 | A1 * | 10/2005 | Fukumoto et al. | 164/457 |
| 2005/0242454 | A1 | 11/2005 | Yuasa et al. | |
| 2006/0042773 | A1 * | 3/2006 | Eisen | 164/319 |
| 2006/0254747 | A1 * | 11/2006 | Ishida et al. | 164/312 |
| 2009/0236494 | A1 | 9/2009 | Hata et al. | |
| 2009/0321037 | A1 | 12/2009 | Lewis | |
| 2010/0084052 | A1 | 4/2010 | Farmer et al. | |
| 2011/0079940 | A1 | 4/2011 | Schroers | |
| 2011/0108231 | A1 | 5/2011 | Zheng et al. | |
| 2012/0048498 | A1 * | 3/2012 | Inaba et al. | 164/254 |

FOREIGN PATENT DOCUMENTS

| | | |
|---|---|---|
| EP | 1415740 | 5/2004 |
| FR | 2665654 | 2/1992 |
| JP | 6212205 | 8/1994 |
| JP | 9272929 | 10/1997 |
| JP | 2000326065 | 11/2000 |
| JP | 2001303218 | 10/2001 |
| JP | 2004050269 | 2/2004 |
| JP | 2006289466 | 10/2006 |
| JP | 2010036210 | 2/2010 |
| WO | WO0037201 | 6/2000 |
| WO | WO2008046219 | 4/2008 |
| WO | WO2009067512 | 5/2009 |

OTHER PUBLICATIONS

International Search Report mailed Jun. 13, 2012, for PCT/US2011/054153.

Shen ET., "Bulk Glassy CO43FE2OTA5.5B31.5 Alloy with High Glass-Forming Ability and Good Soft Magnetic Properties", Materials Transactions, vol. 42 No. 10 (2001) pp. 2136-2139.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky AlNiCe Alloys with Amorphous Surface Layer Prepared by High-Pressure Die Casting", Materials Transactions, JIM, vol. 35, No. 11 (1994), pp. 808-813.

* cited by examiner

"A" AND REVERSE "A" SERIES ASSEMBLIES

"B" SERIES ASSEMBLY

"X" SERIES (STRIPPER PLATE) ASSEMBLY

"AX" SERIES ASSEMBLY

"T" SERIES ASSEMBLY

VACUUM MOLD

BACKGROUND

1. Field

The present disclosure is generally related to vacuum molds for molding amorphous alloys.

2. Description of Related Art

Similar to die-casting, injection molding involves heating a material to a molding temperature and forcing such heated material into a mold. Though injection molding speed may be slower than die-casting, common die-casting defects such as blowhole, cold shut, flow line, and misrun still exist in injection molding. These aforementioned defects can be related to air that is trapped within the molding during injection of the material into the die cavity.

Different vacuum die-casting and injection molding processes were developed during the 1980's and 1990's to resolve issues such as these. One type of vacuum that was discussed in vacuum die-casting and injection molding processes is classified as a "low vacuum," which is defined as having a vacuum pressure above 1 Torr, or, in some cases, above 25 Torr. At this vacuum level, die-casting and injection molding of plastic and metals that are not sensitive to oxygen and nitrogen can be molded. However, casting or molding oxygen and nitrogen sensitive alloys using these technologies, methods, and/or this vacuum generally produces a product of poor or low quality.

For example, amorphous alloy is a new class of material that can be injection molded at lower temperature than its individual constituent. Most amorphous alloys, except precious metal based, are sensitive to oxygen and nitrogen; therefore, they can not be cast or molded using conventional vacuum injection molding methods. Some injection molding machines have molds that are outside the vacuum chamber, which increases the risk of exposure of the amorphous alloy to air (e.g., due to leaks in the mold). Thus, an improved vacuum mold system for injection molding of amorphous alloys when using a system that has a vacuum mold that is outside the vacuum chamber portion of the system can be developed.

SUMMARY

One aspect of the disclosure provides a vacuum mold having: at least a first plate and a second plate configured to mold amorphous alloy material therebetween so as to substantially eliminate exposure of the amorphous alloy material therebetween to oxygen and nitrogen; an enclosed ejector box positioned adjacent the at least first and the second plates that is configured to be vacuum sealed by vacuum pressure from at least one vacuum source; at least one vacuum port in communication with the at least one vacuum source that is configured to apply vacuum pressure to the at least first and second plates and the enclosed ejector box; an ejector mechanism in the enclosed ejector box configured to eject molded amorphous alloy material from between the at least first and second plates; and a plurality of seals configured to be positioned between adjacent interfaces of the at least first plate, the second plate, and the enclosed ejector box.

Another aspect of the disclosure provides a vacuum mold having: at least a first plate and a second plate configured to mold amorphous alloy material therebetween so as to substantially eliminate exposure of the amorphous alloy material therebetween to oxygen and nitrogen; an injection system configured to inject melted amorphous alloy material between the at least first plate and the second plate; at least one vacuum port in communication with at least one vacuum source that is configured to apply vacuum pressure to a mold cavity positioned between the at least first and second plates; an enclosed ejector box that is configured to be vacuum sealed with respect to the second plate by vacuum pressure from the at least one vacuum source; an ejector mechanism in the enclosed ejector box configured to eject molded amorphous alloy material from between the at least first and second plates, the ejector mechanism having an actuation portion configured to extend through an opening in the enclosed ejector box, and a seal configured to be positioned between each adjacent interfaces of: (a) the at least first plate and the second plate, (b) the second plate and the enclosed ejector box, and (c) the opening of the ejector box and the actuation portion of the ejector mechanism.

Yet another aspect of the disclosure provides a method of manufacturing a part of amorphous alloy material using a vacuum mold including: obtaining at least a first plate and a second plate configured to mold amorphous alloy material therebetween so as to substantially eliminate exposure of the amorphous alloy material therebetween to oxygen and nitrogen, the at least first and the second plates configured to be positioned adjacent an enclosed ejector box with a plurality of seals between adjacent interfaces of the at least first plate, the second plate, and the enclosed ejector box and configured to be vacuum sealed by vacuum pressure from at least one vacuum source configured to apply vacuum pressure to the at least first and second plates and the enclosed ejector box; applying a vacuum pressure to the at least first and second plates and the enclosed ejector box via at least one vacuum port in communication with the at least one vacuum source; injecting molten amorphous alloy material into a cavity between the at least first and second plates to mold the part; releasing the vacuum pressure applied to the at least first and second plates and the enclosed ejector box via the at least one vacuum port; moving the at least first plate and the second plate relative to and away from each other; actuating an ejector mechanism positioned within the enclosed ejector box by moving an actuation portion extending through an opening in the enclosed ejector box, and ejecting the molded part from between the at least first and second plates using the ejector mechanism.

Other features and advantages of the present disclosure will become apparent from the following detailed description, the accompanying drawings, and the appended claims.

DETAILED DESCRIPTION

The methods, techniques, and devices illustrated herein are not intended to be limited to the illustrated embodiments.

Figure 1:
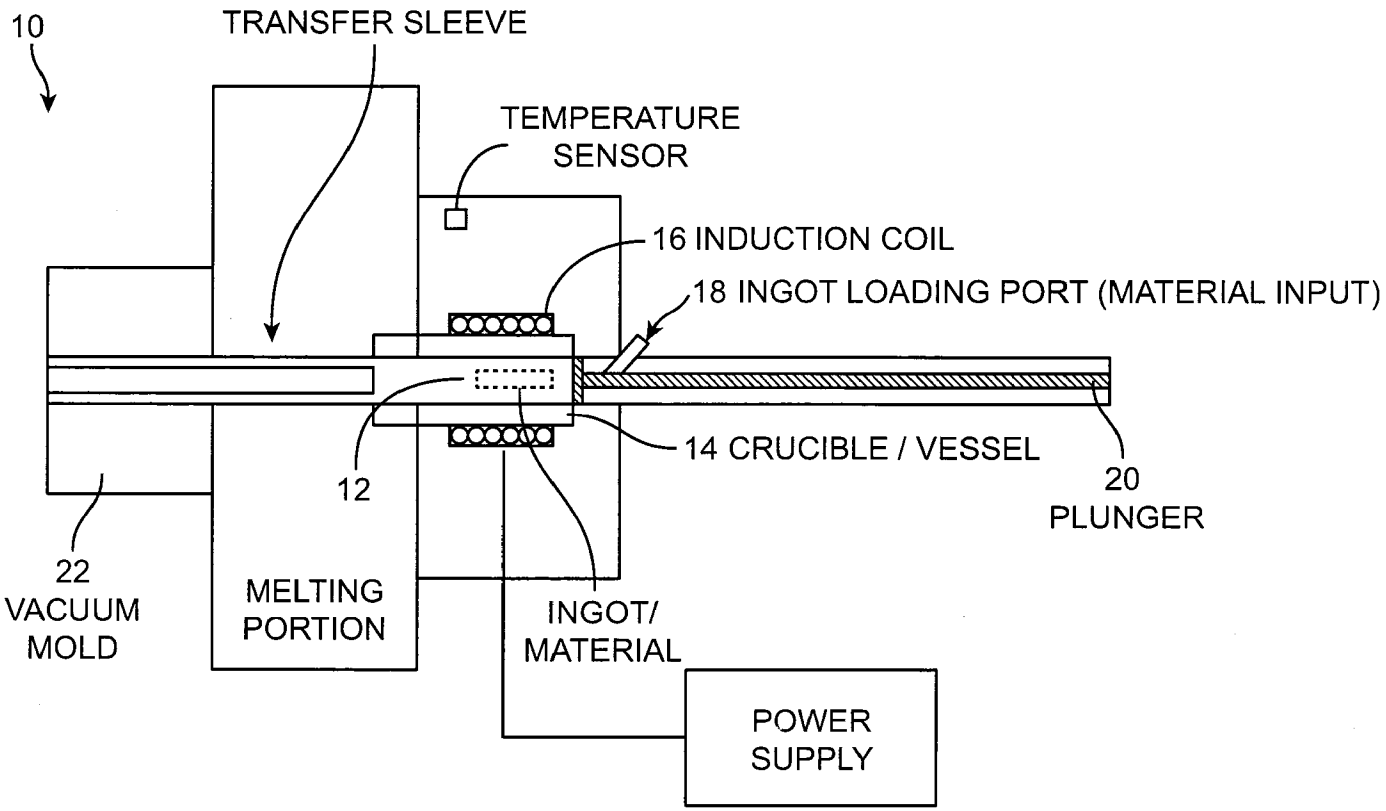
FIG. 1 illustrates a schematic diagram of an exemplary system for using a vacuum mold.

As previously noted, systems that are used to mold materials such as metals or alloys may implement a vacuum when forcing molten material into a die cavity. FIG. 1 illustrates a schematic diagram of such an exemplary system. More specifically, FIG. 1 illustrates an injection molding system 10. The illustrated injection molding system is configured to inject material in a substantially horizontal direction using at least one plunger configured to move in a longitudinal direction. In an embodiment, system 10 may utilize embodiments of the vacuum mold 22 illustrated and described below. The system may perform insertion of the material, melting, and molding under vacuum pressure. Such a system may utilize a boat style melting system, in which a temperature regulated vessel 14 (or crucible or base) includes a body for receiving material to be melted therein. The material may be inserted via a loading port 18 (e.g., in the form of an ingot) and received in a melting portion 12 or surface. Melting portion 12 has a surface that is heated, for example, via an induction coil 16 positioned adjacent the vessel body. In an embodiment where a boat or crucible type vessel that has a length and extends in a longitudinal direction, its melting portion 12 also extends in a longitudinal direction, for example. Cooling line(s) may be positioned relative to melting portion 12 such that material within and/or on the receiving portion 12 is melted and the vessel temperature is regulated (i.e., heat is absorbed, and the vessel is cooled) and maintained at a consistent temperature. Vessel 14 may also have an inlet for inputting material (e.g., feedstock) into receiving portion 12 of its body. After the material is melted using a device such as the boat style melting system, a plunger 20 may be configured to be used to force the melted material from the vessel 14 (plunger 20 may also be configured to push a material for melting into the body 12). Plunger 20 may be configured to move the melted material from the melting portion 12 in a substantially horizontal direction through a transfer sleeve (also called a cold sleeve) and into a vacuum mold 22 for molding. Such a system, however, is not meant to be limiting. For example, a dual plunger system may be utilized. Alternatively, in an embodiment, the vacuum mold 22 may be configured for use with a system positioned in a vertical direction, i.e., configured to inject material downwardly vertically into the mold. Accordingly, the illustrated positions and directions of the injection system of FIG. 1 and/or vacuum mold as described herein are not meant to be limiting.

As will become further evident by the later description, vacuum mold 22 is an enclosed structure configured to mold materials under vacuum pressure while substantially eliminating exposure of material being molded therebetween to oxygen and nitrogen.

The material to be molded (and/or melted) using a vacuum mold as disclosed herein may include any number of materials and should not be limited. In one embodiment, the material to be molded is an amorphous alloy, which are metals that may behave like plastic, or alloys with liquid atomic structures. More specifically, an "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, is too fast for crystals to form and the material is "locked in" a glassy state. Also, amorphous metals can be produced with critical cooling rates low enough to allow formation of amorphous structure in thick layers (over 1 millimeter); these are known as bulk metallic glasses (BMG).

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials, may lead to better resistance to wear and corrosion. Amorphous metals, while technically glasses, may also be much tougher and less brittle than oxide glasses and ceramics.

Thermal conductivity of amorphous materials may be lower than that of the crystalline counterparts. To achieve formation of an amorphous structure even during slower cooling, the alloy may be made of three or more components, leading to complex crystal units with higher potential energy and lower chance of formation. The formation of amorphous alloy can depend on several factors: the composition of the components of the alloy; the atomic radius of the components (preferably with a significant difference of over 12% to achieve high packing density and low free volume); and the negative heat of mixing of the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used.

Another useful property of bulk amorphous alloys is that they can be true glasses; in other words, they can soften and flow upon heating. This allows for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

An amorphous metal or amorphous alloy can refer to a metal-element-containing material exhibiting only a short range order—the term "element" throughout this application refers to the element found in a Periodic Table. Because of the short-range order, an amorphous material can sometimes be described as "glassy." Thus, as explained above, an amorphous metal or alloy can sometimes be referred to as "metallic glass" or "Bulk Metallic Glass" (BMG).

The terms "bulk metallic glass" ("BMG"), bulk amorphous alloys, and bulk solidifying amorphous alloys are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous. A partially amorphous composition can refer to a composition at least about 5 vol % of which is of an amorphous phase, such as at least about 10 vol %, such as at least 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or different chemical composition. In one embodiment, they have substantially the same chemical composition. In another embodiment, the crystalline phase can be more ductile than the BMG phase.

The methods described herein can be applicable to any type of amorphous alloys. Similarly, the amorphous alloys described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, or combinations thereof. Namely, the alloy can include any combination of these elements in its chemical formula or chemical composition. The elements can be present at different weight or volume percentages. For example, an iron "based" alloy can refer to an alloy having a non-significant weight percentage of iron present therein, the weight percent can be, for example, at least about 10 wt %, such as at least about 20 wt %, such as at least about 40 wt %, such as at least about 50 wt %, such as at least about 60 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. In some embodiments, the alloy, or the composition including the alloy, can be substantially free of nickel, aluminum, or beryllium, or combinations thereof. In one embodiment, the alloy or the composite is completely free of nickel, aluminum, or beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72Al7Zr1 0Mo5W2B15. Another iron-based alloy system that can be used in the coating herein is disclosed in US 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorus germanium and arsenic, totaling up to about 2%, and preferably less than 1%, to reduce melting point. Otherwise incidental impurities should be less than about 2% and preferably 0.5%.

In some embodiments a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance, casting behavior, and oxygen content. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the composition consists essentially of the amorphous alloy (with only a small incidental amount of impurities). In another embodiment, the composition consists of the amorphous alloy (with no observable trace of impurities).

Figure 2:
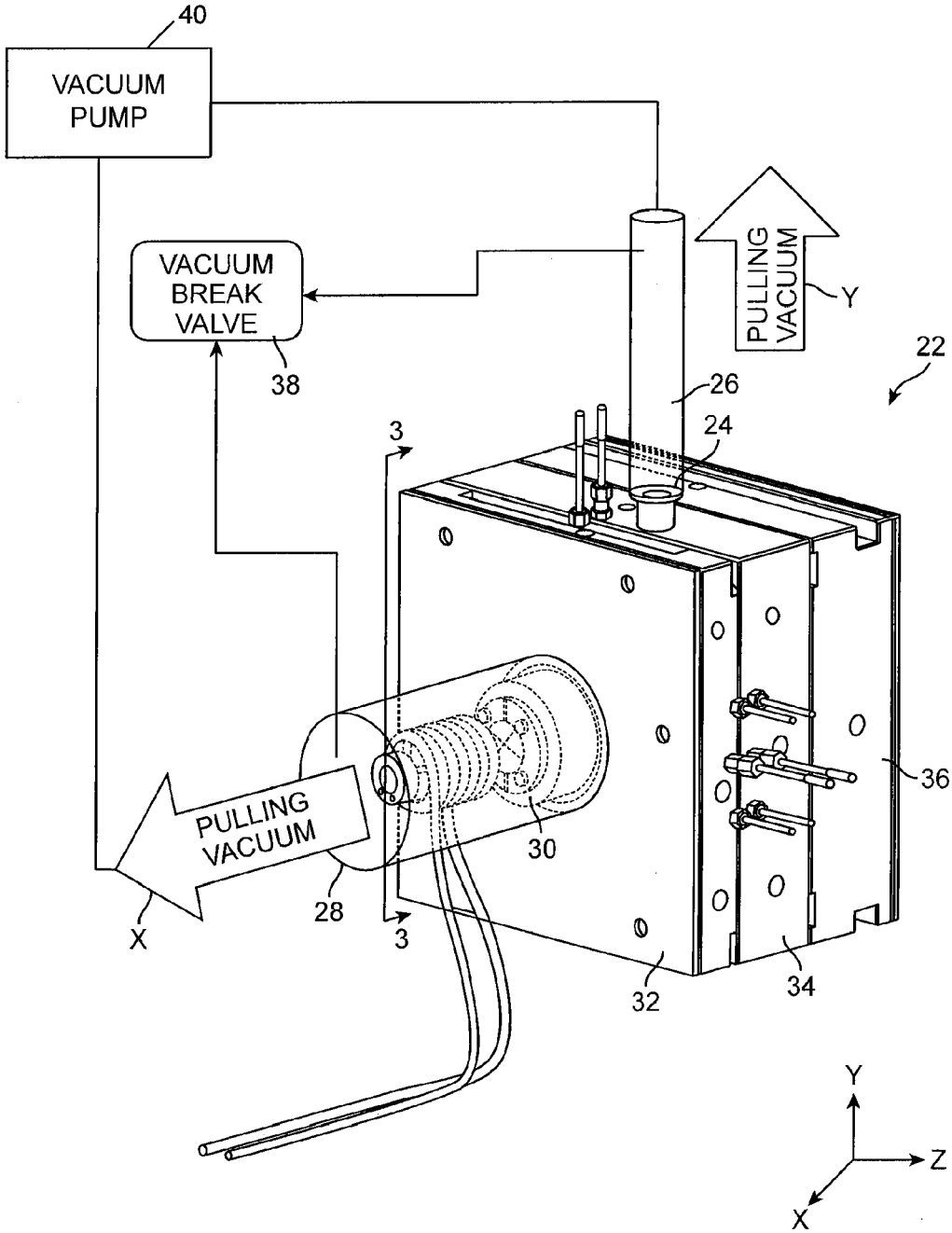
FIG. 2 illustrates a plan view of a vacuum mold in accordance with an embodiment.
Figure 3:
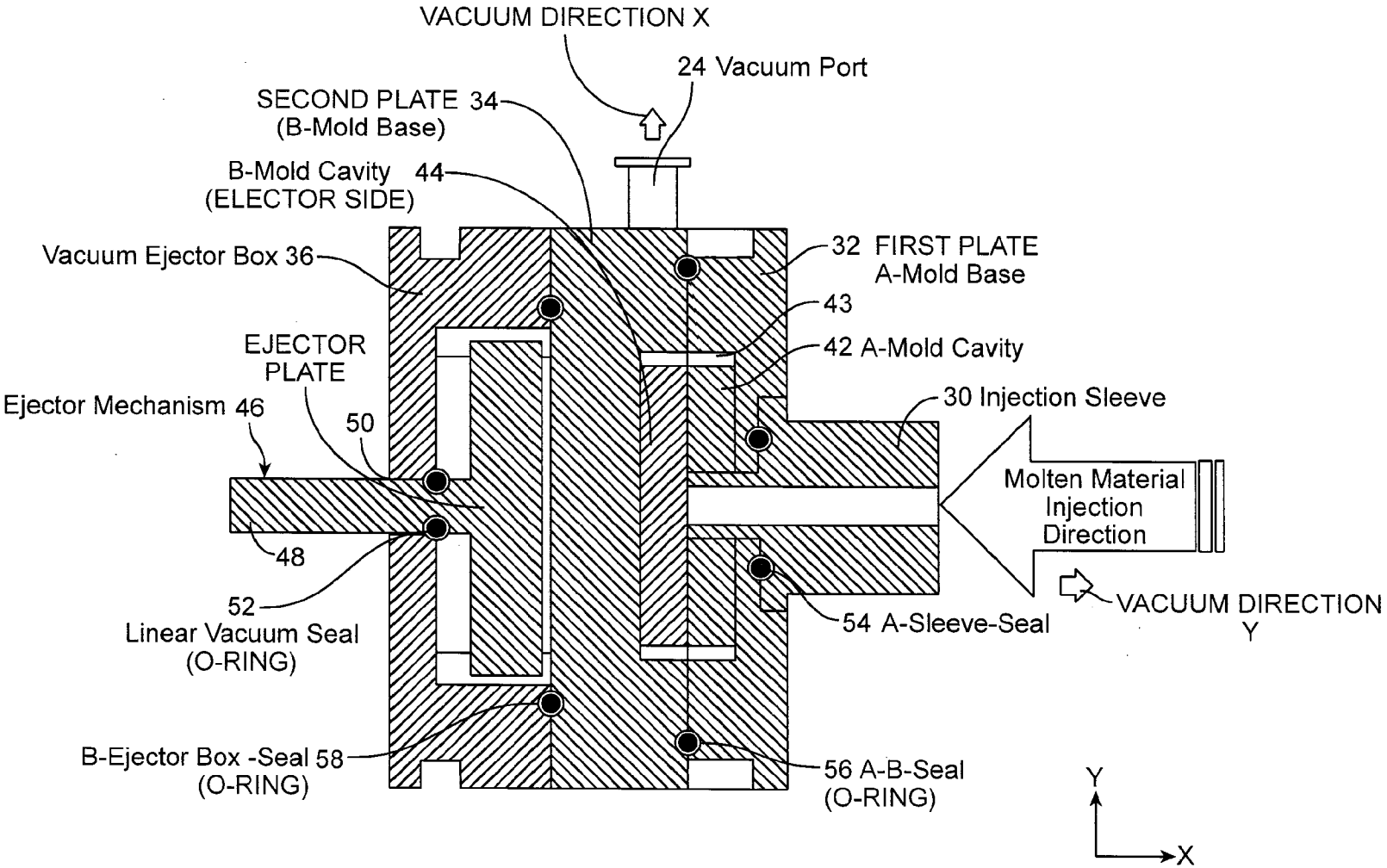
FIG. 3 illustrates a cross-sectional view of the vacuum mold taken through the line 3-3 in FIG. 2.

In an embodiment, such alloys are molded in vacuum mold 22, shown in FIGS. 2 and 3. Vacuum mold 22 may have at least a first plate 32 (also referred to in the art as a "A" plate), a second plate 34 (also referred to in the art as a "B" plate), and a vacuum ejector box 36 positioned adjacently with respect to each other. The at least first plate 32 and second plate 34 are configured to mold material (e.g., amorphous alloy material) therebetween. An injection system with an injection sleeve 30 is configured to inject melted material between the at least first and second plates 32 and 34. In an embodiment, first plate 32 is connected to injection sleeve 30 of injection system.

A mold cavity is provided between the at least first plate 32 and the second plate 34 for molding material. In an embodiment, first plate 32 and second plate 34 each have a mold cavity 42 and 44 (respectively) associated therewith for molding melted material therebetween. For example, as shown in the representative cross-sectional view of FIG. 3, the cavities 42 and 44 may be configured to mold molten material received therebetween via injection sleeve 30 or system. Mold cavity 44 may include a part cavity 45 (see FIG. 10) for forming and molding a part therein.

The at least first and second plates 32 and 34 are configured to substantially eliminate exposure of the amorphous alloy material therebetween to at least oxygen and nitrogen. Specifically, a vacuum is applied such that atmospheric air is substantially eliminates from within the plates 32 and 34 and their cavities 42 and 44. A vacuum pressure is configured to be applied to an inside of vacuum mold 22 using at least one vacuum source 40 that is connected via one or more vacuum lines. For example, the vacuum source 40 may be a pump, as shown in FIG. 2. In an embodiment, a medium-high to high vacuum pressure is provided to at least first and second plates 32 and 34 in vacuum mold 22. Throughout this disclosure, "high vacuum" is defined as a measurement of a vacuum level of about 1×10-9 Torr to about 1×10-3 Torr. "Medium-high vacuum" is defined as a measurement of a vacuum level of about 1×10-3 Torr to about 0.1 Torr. "Medium-low vacuum" is defined as a measurement of a vacuum level of about 0.1 Torr to about 1.0 Torr. "Low vacuum" is defined as a measurement of a vacuum level of about 1 Torr to about 760 Torr. Such measurements may be made by measuring pressure within the melting chamber and within the mold using a tool such as a pirani gauge, for example. Using such a medium-high to high vacuum for molding of materials like amorphous metals is advantageous because it assists in providing an oxygen free environment to the BMG as it is melted (e.g., in the crucible) and molded. The better the vacuum, the less oxygen will be absorbed by the alloy. Under a poor vacuum (e.g., low vacuum), a skin of oxide will form on the surface of the molten alloy, which can cause oxides to be present within the final cast part and reduce the recyclability of the material, as well as creates potential for flow defects within the part. Such oxides can cause the material to flow abnormally, for example. A higher vacuum, such as is used in the herein described system, reduces and/or eliminates such effects.

Additionally, use of a higher vacuum enables quicker removal of gasses from within the mold 22. This reduces an effect of backpressure within the mold and its mold cavity by stopping the molten material from flowing easily into the thinner sections. Accordingly, by using a medium-high to high vacuum and seals (further described below), the vacuum mold 22 reduces and/or eliminates entrance of oxygen and air into the mold 22, thus reducing and/or eliminating material exposure and effects from sensitivity. It also assists in the molding process.

In accordance with an embodiment, vacuum mold 22 maintains a medium-high to high vacuum therein when vacuum pressure is applied thereto using at least one vacuum source 40, i.e., a vacuum pump. At least one vacuum port 24 is in communication with the at least one vacuum source 40 and is configured to apply vacuum pressure to at least the first and second plates and an enclosed ejector box 36 of the vacuum mold 22 at the selected (medium-high to high) vacuum. In the embodiment illustrated in FIG. 2, for example, at top portion of second plate 34 may have a first vacuum port 24 that is connected to vacuum pump 40 via vacuum line 26. First vacuum port 24 may be welded to a top of the plate 34 and/or another part of the mold 22, for example. First vacuum port 24 is generally configured to apply vacuum pressure with respect to at least area 43 adjacent first and second plates 32 and 34 in a first direction.

In accordance with an embodiment, vacuum mold 22 can have a second vacuum port in communication with the at least one vacuum source 40 via second vacuum line 28 and is configured to apply vacuum pressure from the source (pump 40) to the first and second plates 32 and 34, the mold cavities, and the enclosed ejector box 36 in a second direction with respect to at least area 43. In another embodiment, the second direction (e.g., X direction, as shown in FIGS. 2 and 3) for applying vacuum to the mold 22 is perpendicular to the first direction (e.g., Y direction). In an embodiment, the second vacuum line 28 is connected to vacuum pump 40 to apply vacuum pressure through the area at injection sleeve 30. The region around the temperature regulated vessel 14 may also be evacuated while the body (or inside) of the vessel 14 is not evacuated (so that a temperature regulated fluid can travel through channels on the inside of the vessel 14).

However, the illustrated directions and locations for applying the first and/or second vacuum ports 24 and 30 (and lines 26 and 28) is exemplary and not meant to be limiting. For example, in an embodiment, the vacuum port may be applied and pulled through a platen, a part adjacent to an injection site, a part adjacent to the mold plates, or other part of an injection molding machine. The X and Y directions are for illustrative purposes only. Other directions for applying vacuum pressure may be used.

In an embodiment, the vacuum pump 40 can apply vacuum pressure to at least the first and second plates 32 and 34 via first vacuum port 24 in a first direction and via second vacuum port 30 in a second direction. That is, when the vacuum pump 40 is instructed to, a vacuum pressure is applied (i.e., pulled) in the first direction (e.g., in a direction as indicated by arrow Y; along Y-axis) with respect to vacuum mold 22. Vacuum pump 40 is also configured to simultaneously apply vacuum pressure in a second direction (e.g., in a direction as indicated by arrow X; along X-axis) with respect to vacuum mold 22.

In accordance with an embodiment, in order to assist in releasing vacuum pressure from inside the vacuum mold 22, a vacuum release valve (or break valve) 38 is added and/or connected to vacuum line(s) and/or one or more vacuum ports 24 and/or 30, between vacuum pump 40 and vacuum mold 22. Vacuum release valve 38 is configured to release vacuum pressure applied to the at least first plate 32, second plate 34, and the enclosed ejector box 36. The addition of vacuum release valve 38 enables release of vacuum pressure from inside of the vacuum mold 22 prior to opening it, for example. This stops a rapid stream of air from flowing into the mold causing potential contamination of the vacuum region. It also allows for a controlled release of the vacuum, and prevents pressure stopping components such as the below described seals from being dislodged from the mold parts. In an embodiment, the vacuum release valve 38 also contains a filter that is configured to block dust and other particles from being pulled into a chamber of the mold 22.

Figure 10:
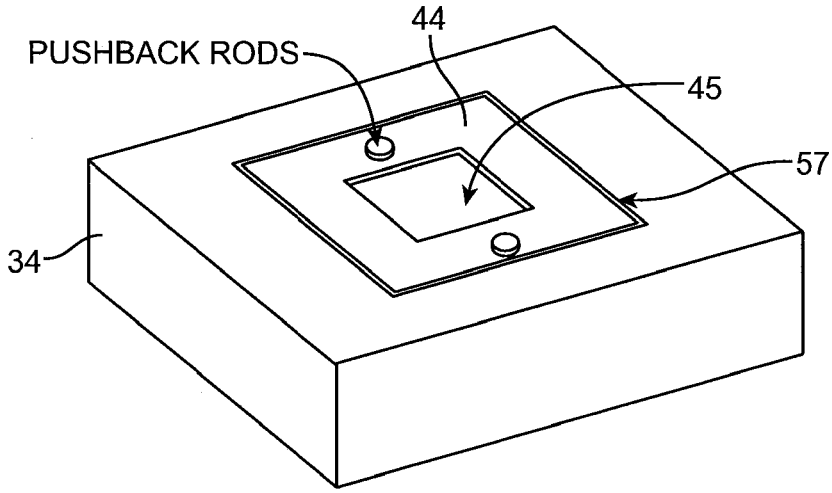
FIG. 10 illustrates a perspective view of the enclosed ejector box and second plate of the mold of FIG. 2.
Figure 10:
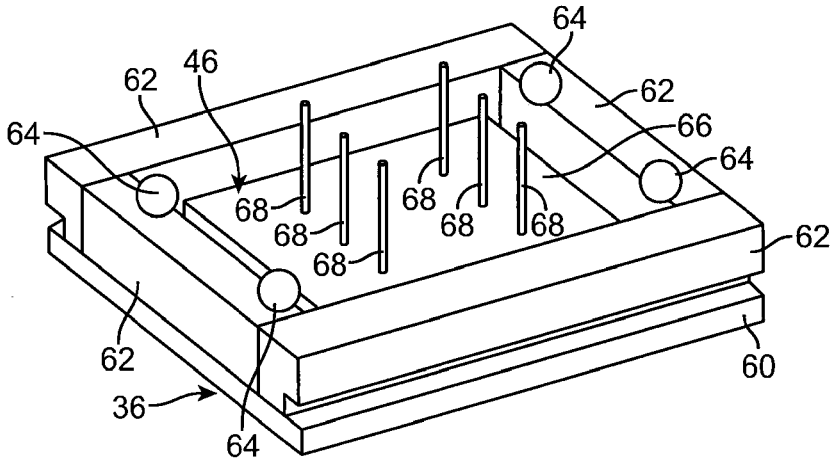

Also shown in FIG. 3 is a cross-sectional view of enclosed vacuum ejector box 36. The enclosed vacuum ejector box 36 is positioned adjacent the at least first and second plates 32 and 34 and is configured to be vacuum sealed by vacuum pressure from the vacuum source 40 (pump). In accordance with an embodiment, vacuum ejector box 36 is vacuum sealed with respect to the second plate 34. In another embodiment, vacuum ejector box is vacuum sealed relative to a support plate in the mold 22. The vacuum ejector box 36 is designed and configured to form an enclosure with respect to its adjacent plate such that a medium-high to high vacuum pressure is maintained therein. As shown in greater detail in FIG. 10, ejector box 36 includes a back or base plate 60 and a number of side plates 62 extending therefrom (e.g., four side plates, extending along a top, two sides, and a bottom side). It forms an enclosure with an open face that is configured to mate and seal with a rear side of the second plate 34. More specifically, the ejector box 36 has five closed faces, four of which are parallel to ejector pins 68 of the vacuum ejector box 36. FIG. 10 also generally shows a number of exemplary return pin locations 64 for the adjacent mold parts.

In an embodiment, included in the enclosed vacuum ejector box 36 is an ejector mechanism 46 configured to eject molded amorphous alloy material from between the at least first and second plates 32 and 34. Specifically, the ejector mechanism 46 ejects molded material from the mold cavities 42 and 44. The ejector mechanism 46 is vacuum sealed within the enclosed vacuum ejector box 36 and any adjacent plate or interface sealed with the open face of the box 36. For example, in an embodiment, vacuum ejector box 36 and second plate 34 fully enclosed the ejector mechanism 46. In another embodiment, the vacuum ejector box 36 is sealed via an interface with a support plate.

The ejector mechanism 46 may include an ejector plate 66, in accordance with an embodiment. The ejector plate is configured to move within the enclosed ejector box to eject the molded material from the mold 22. More specifically, the ejector plate 66 may have one or more (multiple) ejector pins 68 extending in a linear direction therefrom. Upon movement of the ejector plate 66, the ejector pins 68 are moved relatively to eject the molded material from the mold cavity of the mold 22.

In an embodiment, the ejector mechanism 46 has an actuation portion 48 in the form of a linear extension that extends through an opening 50 in the enclosed ejector box 36. In an embodiment, the opening 50 is provided in the base plate 60. The ejector plate 66 is connected to the actuation portion 48. The actuation portion 48 is configured to be actuated via an actuator mechanism from outside the enclosed vacuum ejector box 36.

In an embodiment, ejector mechanism 46 is designed to move linearly with respect to at least the vacuum ejector box 36 and/or the mold 22 itself. In an embodiment, the vacuum mold 22 is positioned in a horizontal direction. Molten material is injected from the temperature regulated vessel 14 via injection sleeve 30 into the mold cavities in a horizontal direction. Thus, ejector mechanism 46 may be configured to move linearly in an X-direction along X-axis, such that it moves the ejector plate 66 within the enclosed ejector box 36, relative to its side walls 62, between a position that is adjacent the base plate 60 and a position that is adjacent the back of the rear side of second plate 34, to eject the molded material. The ejector pins 68 may be configured to push molded material away from cavity 44, for example.

In an embodiment, to assist in maintaining a vacuum pressure or seal within vacuum mold 22 between components of vacuum mold 22, and to further assist in substantially eliminating exposure of the amorphous alloy material therebetween to oxygen and nitrogen, one or more seals are provided between adjacent components of the mold 22. Seals can assist during formation of a part of the molten material when under vacuum pressure, by substantially limiting or eliminating substantial exposure or leakage of air into the mold 22. For example, the seals may be in the form of an O-ring. A seal is defined as a device that can be made of any material and that stops movement of material (such as air) between parts which it seals. In an embodiment, one or more seals are configured to be placed between each of the adjacent interface of at least the first plate 32, the second plate 34, and the enclosed ejector box 36. That is, in an embodiment as shown in FIG. 3, one or more seals 56 are placed between interfaces of first plate 32 and second plate 34 to seal their adjacent mating surfaces. One or more seals 58 are also placed between an adjacent interface between second plate 34 and the vacuum ejector box 36. In an embodiment, a seal 54 is provided between the first plate 32 and the injection sleeve 30 to create a vacuum seal therebetween.

As previously noted, actuation portion 48 extends through and moves within opening 50 of the base plate 60 of enclosed ejector box 36. In order to maintain a vacuum seal within the enclosed vacuum ejector box 36 and to prevent pressure loss within the vacuum mold 22, in an embodiment, a seal 52 is provided between adjacent interfaces of the opening 50 in the base plate 60 of the vacuum ejector box 36 and the linear actuation portion 48. In an embodiment, the seal 52 may be secured with respect to the vacuum ejector box 36.

In an embodiment, such as shown in FIG. 3, a seal 56, 58, and 52 is configured to be positioned between each adjacent interfaces of: (a) the at least first plate 32 and the second plate 34, (b) the second plate 34 and the enclosed ejector box 36, and (c) the opening 50 of the ejector box 36 and the actuation portion 48 of the ejector mechanism 46.

It should be noted that the positioning and/or attachment location of any of the above described seals are not meant to be limiting. Rather, the seals are positioned such that they are provided between and/or to seal adjacent surfaces. Testing may be performed to determine a strategic location for application of the one or more seals. Also, the face or side of the plates used to for insertion and to hold the seal therein is not limited. For example, in an embodiment, seal 56 and/or first plate 32 may be constructed such that seal 56 is attached to first plate 32 (so that when plates 32 and 34 are opened and separated, seal 56 remains attached to first plate 32). In another embodiment, seal 56 and/or second plate 34 may be constructed such that seal 56 is attached to second plate 34. One or more of the plates may have grooves that are formed during manufacturing of the parts. For example, FIG. 10 illustrates an example of a groove 57 formed in second plate 34 for receiving seal 56. The types, shapes, sizes, and/or materials of the seals used with vacuum mold 22 should not be limited. For example, as previously noted, O-rings may be used to seal the adjacent parts relative to one another. However, seals may be of oval, circular, or polygonal shape.

In an embodiment, one or more seals are placed between adjacent interfaces of any two plates or parts in the vacuum mold 22. For example, the illustrated vacuum mold 22 of FIGS. 2 and 3 is a representative depiction of a mold that may be used in an injection molding system, such as system 10 in FIG. 1.

Also, the shape of the mold and its parts should not be limited. For example, in an embodiment, the ejector box 36 is cylindrical in shape with one end open to an adjacent plate (e.g., second plate 34) and the other end connected to another plate (e.g., base plate 60). Also, although the enclosed ejector box 36 is generally illustrated with side plates 62 extending from base plate 60, it should be understood that the parts can be formed integrally to each other and/or attached to each other using any number of attachment devices. In another embodiment, base plate 60 may be movable relative to the side plates 62. However, seals and/or other devices may be used to ensure a vacuum sealed area within the box 36.

The embodiment illustrated in FIGS. 2, 3, and 10, for example is exemplary and has been simplified for explanatory purposes only. That is, it should be understood by one of skill in the art that additional parts or components are provided within the mold, which may include, but are not limited to, pushback rods, return pins, and vents.

Moreover, although the illustrated embodiment and corresponding description refer to the mold 22 as having first and second plates 32 and 34 with a mold cavity formed by 42 and 44 therebetween, it should be understood that any number of additional plates may be provided between and/or adjacent the first and second plates to form the mold, and that one or more additional support plates may also be provided between and/or adjacent the enclosed ejector box. As shown in FIGS. 4-9, one or more additional support plates (sometimes referred to as an "X," "X-1," or "X-2" plate) may be provided adjacent to and/or between the at least first and second plates 32 and 34 and/or the ejector box 36, depending on the mold assembly being utilized. In accordance with an embodiment, at least one support plate is provided adjacent the at least first plate 32, the second plate 34 and/or the ejector box 36. The at least one support plate is configured to assist in molding material and is configured to be vacuum sealed to the at least first plate 32, the second plate 34, and/or the ejector box 36 by vacuum pressure from the at least one vacuum source 40.

More specifically, FIGS. 4-9 illustrate additional exemplary vacuum mold assemblies, each of which may be part of and/or used with the injection molding system of FIG. 1, in accordance with some embodiments. Each of the FIGS. 4-9 show a side view of each of the mold assemblies on a left side of the drawing and a cross section (indicated by the vertical line) of the same mold assembly on the right side of the drawing. The cross sections indicate a location of seals using a plus sign "+" that may be used between the plates and/or adjacent interfaces of the mold parts, as further noted below. Also, it should be noted that although each of the mold assemblies in FIGS. 4-9 are shown positioned vertically, the mold assemblies can be designed to be positioned horizontally such that material is injected horizontally between the plates into the mold cavity and the ejector plate 66 moves in a horizontally linear direction to eject the molded material upon completion of the molding process. Further, it should be understood that molds such as these may be formed, manufactured, or adjusted (e.g., manipulating existing molds) such that the ejector box 66 is enclosed on its back and all four sides so that only a front side may be opened, and configured to be vacuum sealed with respect to a face of an adjacent plate. Each of the mold assemblies are configured to mold metal or alloy material therebetween, while substantially eliminating exposure of the material therebetween to oxygen and nitrogen during the process.

Figure 4:
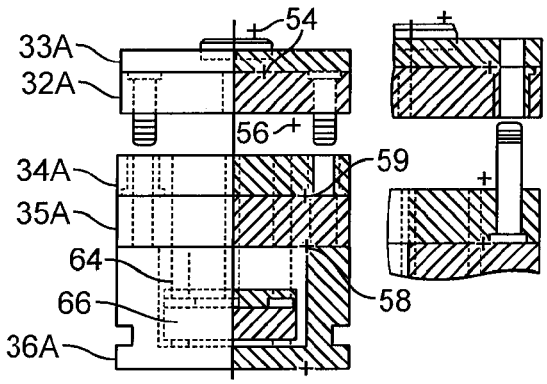
FIGS. 4-9 illustrate multiple vacuum mold assemblies each for use with the system of FIG. 1 in accordance with multiple embodiments.

For example, the mold in FIG. 4 is an "A" series mold assembly which can be configured to be used with the system of FIG. 1, in accordance with an embodiment. The mold assembly has a clamping plate 33A provided adjacent a first or A plate 32A. Adjacent first plate 32A is a second or B plate 34A, followed by an adjacent support plate 35A, and an enclosed ejector box 36A provided adjacent the support plate 35A. Material is injected in between and molded using the plates 32A, 33A, 34A, and 35A. Within ejector box 36A is ejector plate 66 (and rods 64) that is enclosed and configured to be vacuum sealed therein. Seals may be provided between some or each of the interfaces of the plate. As previously noted, seal 54 may be provided adjacent the first plate 32A, in this case between the first plate 32A and the clamping plate 33A. A separate seal may be provided adjacent the clamping plate 33A and the injection sleeve. Seal 56 is provided between adjacent interfaces of the first plate 32A and the second plate 34A. Another seal 59 is provided adjacent interfaces of the rear side of the second plate 34A and a front side of the support plate 35A. The open face of the enclosed ejector box 36A (formed by its side plates) interfaces with a rear side of the support plate 35A and seal 58 may be provided therebetween. In an embodiment, another seal is provided on a rear side of the base plate of the ejector box 36A.

Figure 5:
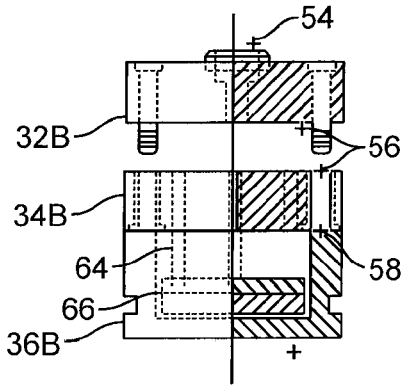

FIG. 5 shows a "B" series mold assembly that may be configured for use with the system of FIG. 1. This assembly is similar to the exemplary embodiment shown in FIGS. 2 and 3. The mold assembly has a first plate 32B and second plate 34B adjacent each other, with a seal 56 between their adjacent faces. Adjacent the second plate 34B on a rear side is enclosed ejector box 36B. Seal 58 is provided between their adjacent faces. A seal 54 is provided on a front face of the first plate 32B, which may be provided against an interface with an injection sleeve. Material is injected in between and molded using the plates 32B and 34B. Within ejector box 36B is ejector plate 66 (and rods 64) that is enclosed and configured to be vacuum sealed therein. In an embodiment, a seal is provided on a rear side of the base plate of the ejector box 36B.

Figures 6, 7:
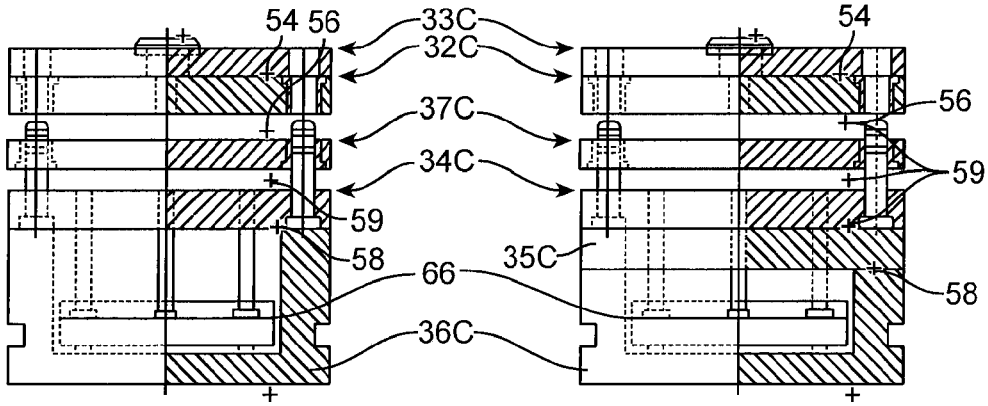

FIGS. 6 and 7 illustrate "X" series mold assemblies that may be configured for use with the system of FIG. 1, in accordance with an embodiment. Each of the assemblies has a clamping plate 33C adjacent a first ("AX") plate 32C. Adjacent first plate 32C is a support or "X" plate 37C, which is adjacent a second ("BX") plate 34C. In the embodiment of FIG. 6, the enclosed ejector box 36C provided adjacent the support plate 35A. In the embodiment of FIG. 7, an additional support plate 35C is provided on a rear side of the second plate 34C, and the enclosed ejector box 36C is provided adjacent the additional support plate 35C. Material is injected in between and molded using the plates. Within ejector box 36C is ejector plate 66 (and rods 64) that is enclosed and configured to be vacuum sealed therein. Seals may be provided between some or each of the interfaces of the plate. As previously noted, seal 54 may be provided adjacent the first plate 32C, in this case between the first plate 32C and the clamping plate 33C in both FIGS. 6 and 7. A separate seal may be provided adjacent the clamping plate 33A and the injection sleeve. Seal 56 is provided between adjacent interfaces of the first plate 32C and the support or "X" plate 37C. Another seal 59 is provided adjacent interfaces of the rear side of the support plate 37C and the front side of the second plate 34C. In FIG. 6, open face of the enclosed ejector box 36C (formed by its side plates) interfaces with a rear side of the second plate 34C and seal 58 may be provided therebetween.

Alternatively, as shown in FIG. 7, additional seals 59 may be provided between a rear side of the second plate 34C and a front side of the support plate 35C. The open face of the enclosed ejector box 36C (formed by its side plates) interfaces with a rear side of the support plate 35C and seal 58 may be provided therebetween.

In either embodiment, another seal can be provided on a rear side of the base plate of the ejector box 36C.

Figure 8:
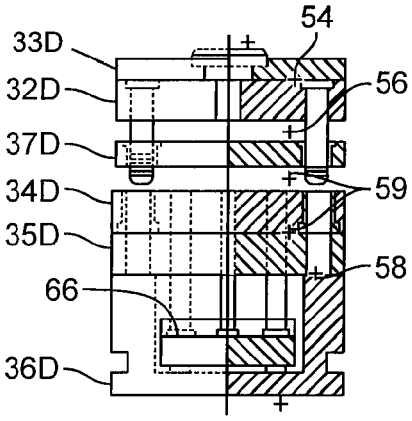

The mold in FIG. 8 is an "AX" series mold assembly which can be configured to be used with the system of FIG. 1, in accordance with an embodiment. The mold assembly has a clamping plate 33D provided adjacent a first or A plate 32D. Adjacent first plate 32D is a support or "X-1" plate 37C, which is followed by second or B plate 34D. An additional adjacent support plate 35D is adjacent the second plate 34D and an enclosed ejector box 36D provided adjacent the support plate 35D. Material is injected in between and molded using the plates 32D, 33D, 34D, 35D, and 37D. Within ejector box 36D is ejector plate 66 (and rods 64) that is enclosed and configured to be vacuum sealed therein. Seals may be provided between some or each of the interfaces of the plate. Seal 54 may be provided adjacent the first plate 32D, in this case between the first plate 32D and the clamping plate 33D. A separate seal may be provided adjacent the clamping plate 33D and the injection sleeve. Seal 56 is provided between adjacent interfaces of the first plate 32D and the support X-1 plate 37D. Additionally, a plurality of seals 59 are provided adjacent interfaces of the rear side of the support plate 37D and a front side of the second plate 34D, and the rear side of the second plate 34D and a front side of the support plate 35D. The open face of the enclosed ejector box 36D (formed by its side plates) interfaces with a rear side of the support plate 35D and seal 58 may be provided therebetween. In an embodiment, another seal is provided on a rear side of the base plate of the ejector box 36D.

Figure 9:
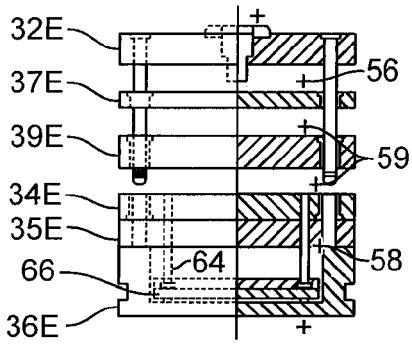

FIG. 9 shows a "T" series mold assembly that may also be configured for use with the system of FIG. 1. The mold assembly has a first plate 32E and second plate 34E with two support plates 37E and 39E therebetween. Additionally, a support plate 35E is provided on a rear side of the second plate 34E. Adjacent the support plate 35E on a rear side is enclosed ejector box 36E. Seal 58 is provided between their adjacent faces. A seal 54 is provided on a front face of the first plate 32E, which may be provided against an interface with an injection sleeve. Seal 56 is provided between adjacent interfaces of the rear side of the first plate 32E and the front side of the support plate 37E. Also, seals 59 are provided adjacent interfaces of the rear side of the support plate 37E and a front side of the support plate 39E, and the rear side of the support plate 39E and a front side of the second plate 34D. Material is injected in between and molded using the plates. Within ejector box 36E is ejector plate 66 (and rods 64) that is enclosed and configured to be vacuum sealed therein. In an embodiment, a seal is provided on a rear side of the base plate of the ejector box 36E.

In any of the above described embodiments of FIGS. 4-9, mold cavities (e.g., 42 and 44) may be provided in any number of ways and in any number of configurations between any of the adjacent plates. Also, with respect to these and other embodiments, the one or more vacuum ports may be provided at any number of locations and should not be limited to the connections illustrated in FIG. 2.

During operation, the vacuum mold 22 and/or the injection system of FIG. 1 can be semi-automated. In an embodiment, the vacuum pressure seal on the mold 22 may be released any number of times during the process of melting and molding material. For example, the vacuum seal may be broken each time a new material ingot is loaded into the injection system. In an embodiment, the vacuum seal is broken to release the molded material.

Figure 11:
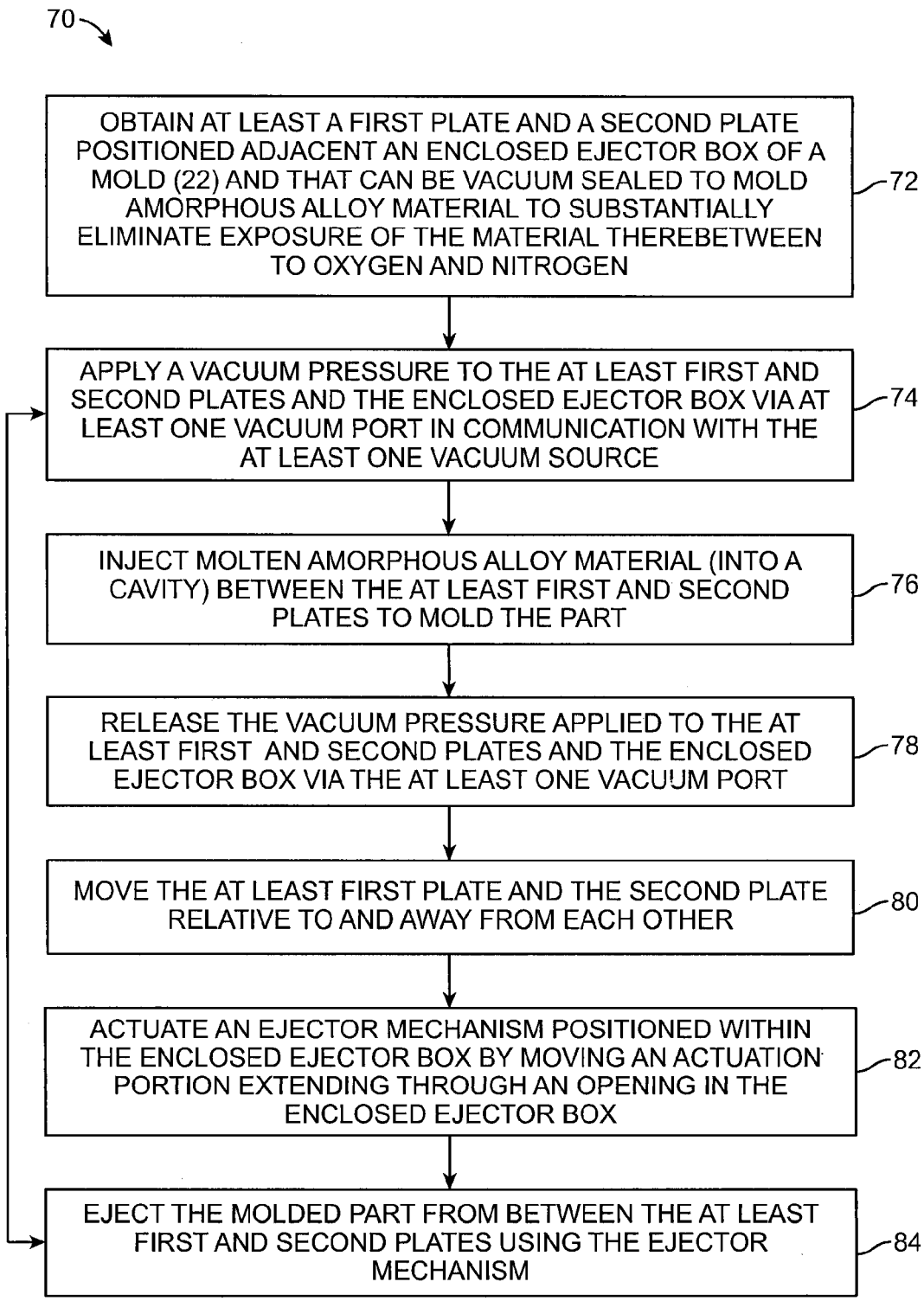
FIG. 11 illustrates a method for manufacturing a part using a vacuum mold of FIG. 1 or 4-9, in accordance with an embodiment.

As an example, FIG. 11 illustrates a method 70 for manufacturing a part molded from amorphous alloy using a vacuum mold such as mold 22. The method 70 includes obtaining as shown at 72 at least a first plate and a second plate (32 and 34) configured to mold amorphous alloy material therebetween, so as to substantially eliminate exposure of the amorphous alloy material therebetween to oxygen and nitrogen. The at least first and the second plates 32 and 34 may be configured to be positioned adjacent an enclosed ejector box 36 with a plurality of seals 54, 56, and 58 between adjacent interfaces of the at least first plate, the second plate, and the enclosed ejector box, and configured to be vacuum sealed by vacuum pressure from at least one vacuum source 40 configured to apply vacuum pressure to the at least first and second plates and the enclosed ejector box, as described in detail in the embodiments above. The process may be implemented to melt and form the part using amorphous alloy material under vacuum. Generally, the injection system (e.g., system 10) with vacuum mold 22 may be operated in the following manner: Material (e.g., amorphous alloy or BMG) is loaded into a feed mechanism held under medium-high to high vacuum, and a single ingot (feedstock) is loaded into sleeve through a gate valve. The ingot is inserted and received into the melting zone 12 (away from the loading zone) of the vessel 14 (surrounded by the induction coil 16). The injection molding machine "nozzle" stroke or plunger 20 is used to move the material, as needed. The material is heated through the induction process. The injection molding machine controls the material temperature through a closed loop system which will stabilize the material at a specific temperature (e.g., using a temperature sensor). Once the temperature is achieved and maintained, the machine will then begin the injection of the molten material from the vessel 14, through a transfer (cold) sleeve, and into vacuum mold 22. This may be controlled using a plunger 20, which can be a servo-driven drive or a hydraulic drive.

The molding process or method for molding a part may be implemented as follows: after obtaining the parts of the mold (noted above) at 72, a vacuum pressure is applied at 74 to the at least first and second plates 32, 34 and the enclosed ejector box via 36 at least one vacuum port in communication with the at least one vacuum source 40. The vacuum pressure may be applied when the system 10 is ready for melting, for example (before insertion of an ingot of amorphous alloy). Then at 76 molten amorphous alloy material is injected (e.g., via plunger 20) into a cavity between the at least first and second plates to mold the part. Once the mold cavity has begun to fill, vacuum pressure (via the vacuum lines and vacuum source 40) can be held at a given pressure to "pack" the molten material into the remaining void regions within the mold cavity and mold the material. After the molding process (e.g., approximately 10 to 15 seconds), the vacuum pressure applied to the mold 22 is released at 78. For example, the pressure can be released using vacuum break valve 38 and/or the vacuum port. The mold 22 is then opened to relieve pressure and to expose the part to the atmosphere. More specifically, as shown at 80, the at least first plate and the second plate are moved relative to and away from each other. Then, at 82, an ejector mechanism positioned within the enclosed ejector box is actuated by moving an actuation portion extending through an opening in the enclosed ejector box. The solidified, molded part is then ejected at 84 from between the at least first and second plates of the mold using the ejector mechanism 46 (ejector plate 66 is moved in a horizontal and linear direction using actuation mechanism 48 via an actuation device and the ejector pins 68 assist in ejecting the part from the cavity). The vacuum mold 22 is then closed by moving at least the at least first and second plates relative to and towards each other such that the first and second plates and enclosed ejector box are adjacent each other. The mold 22 is evacuated via the vacuum source 40 (applying vacuum pressure thereto) once the plunger 20 has moved back into an ingot load position, in order to melt more material and mold another part.

The above noted mold parts of vacuum mold 22 may be made of any number of materials. In an embodiment, the mold parts are made of a material with characteristics for molding molten materials, including high hardness and high thermal conductivity. In an embodiment, the vacuum mold 22 may be formed using materials such as Anviloy® or materials with a coating applied to the surface (such as D2 tool steel with a nitride surface treatment). Parts of vacuum mold 22 may also be formed from steel. The materials for forming mold parts may be selected based on the materials to be molded. In an embodiment, a number of different materials may be used to form the parts of vacuum mold 22. Accordingly, the materials used to form the vacuum mold 22 and its parts should not be limited.

The vacuum mold 22 herein described and its features provide an improved manufacturing technique particularly suited for injection molding of amorphous alloy. The quality of the vacuum relates to the level of contamination left inside the system. As previously noted, the higher the vacuum level, the lower the contamination of the material (e.g., from oxygen, nitrogen, air) is obtained. Vacuum mold 22 is a closed pressurized mold (under vacuum pressure), assisted by its used of seals. Use of the seals between adjacent interfaces and application of the vacuum to the inside of the mold aids in more effectively sealing adjacent mold parts. Also, evacuation of the vacuum mold 22 is easy and its parts can be easily moved relative to each other without having to consider evacuation of all of the surrounding parts in the injection molding device.

In accordance with an embodiment, the vacuum mold 22 is a medium-high to high vacuum mold. In an embodiment, the measured vacuum level of vacuum mold 22 as maintained by the at least one vacuum pump 40 is about 10-9 Torr to about 10-1 Torr. In an embodiment, the measured vacuum level of vacuum mold 22 is about 10-9 Torr to about 10-2 Torr. In yet another embodiment, vacuum mold 22 is a high vacuum mold with a measured vacuum level of about 10-9 Torr to about 10-3 Torr.

The enclosed ejector box 36 is configured to be vacuum sealed with two seals 52 and 58. Using ejector plate 66 and a single through point (opening 50) in the ejector box 36 decreases the susceptibility for contamination from outside atmospheric air. Also, the single access point via the actuation mechanism 48 eliminates a need for individual seals for each ejector pin 68 because of connection to ejector plate 66. However, seals may be used in or around points at which ejector pins 68 are provided.

The aforedescribed vacuum mold can be used in a fabrication device and/or process including using BMG (or amorphous alloys). Because of the superior properties of BMG, BMG can be made into structural components in a variety of devices and parts. One such type of device is an electronic device.

An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A vacuum mold comprising:

at least a first plate and a second plate configured to mold amorphous alloy material therebetween so as to substantially eliminate exposure of the amorphous alloy material therebetween to oxygen and nitrogen;

an enclosed ejector box positioned adjacent the at least first and the second plates that is configured to be vacuum sealed by vacuum pressure from at least one vacuum source;

at least a first vacuum port and a second vacuum port both in communication with the at least one vacuum source that is configured to apply vacuum pressure to the at least first and second plates and the enclosed ejector box;

an ejector mechanism in the enclosed ejector box configured to eject molded amorphous alloy material from between the at least first and second plates;

a plurality of seals configured to be positioned between adjacent interfaces of the at least first plate, the second plate, and the enclosed ejector box, and wherein the at least one vacuum source is configured to apply vacuum pressure from the at least one vacuum source to the at least first and second plates and the enclosed ejector box in a first direction using the first vacuum port and in a second direction to the at least first and second plates and the enclosed ejector box using the second vacuum port.

2. The mold according to claim 1, wherein the enclosed ejector box is configured to be vacuum sealed with respect to the second plate.

3. The mold according to claim 1, further comprising a vacuum release valve connected to the at least one vacuum port, and wherein the valve is configured to selectively release vacuum pressure applied to the at least first plate, the second plate, and the enclosed ejector box.

4. The mold according to claim 1, wherein the ejector mechanism further comprises an actuation portion configured to extend through an opening in the enclosed ejector box and an ejector plate connected to the actuation portion, and wherein the actuation portion is configured to move the ejector plate within the enclosed ejector box to eject the molded amorphous alloy material.

5. The mold according to claim 4, further comprising a seal configured to be positioned between the opening of the ejector box and the actuation portion of the ejector mechanism.

6. The mold according to claim 5, wherein the ejector plate further comprises a plurality of ejector pins extending in a linear direction, and wherein the ejector pins are configured to eject the molded amorphous alloy material upon movement of the ejector plate.

7. The mold according to claim 4, wherein the ejector mechanism is configured to move in a horizontal direction with respect to the enclosed ejector box.

8. The mold according to claim 1, further comprising at least one support plate provided adjacent the at least first plate, the second plate and/or the ejector box and that is configured to assist in molding the amorphous alloy material and that is configured to be vacuum sealed to the at least first plate, the second plate, and/or the ejector box by vacuum pressure from the at least one vacuum source.

9. The mold according to claim 8, further comprising one or more seals between adjacent interfaces of the at least one support plate and the at least first plate, second plate, and/or ejector box.

10. The mold according to claim 1, further comprising an injection system configured to inject melted amorphous alloy material between the at least first plate and the second plate in a horizontal direction.

11. The mold according to claim 1, wherein the second direction is different from the first direction.

12. The mold according to claim 1, wherein the second direction is perpendicular to the first direction.

13. A vacuum mold comprising:

at least a first plate and a second plate configured to mold amorphous alloy material therebetween so as to substantially eliminate exposure of the amorphous alloy material therebetween to oxygen and nitrogen;

an injection system configured to inject melted amorphous alloy material between the at least first plate and the second plate;

at least a first vacuum port and a second vacuum port both in communication with at least one vacuum source that is configured to apply vacuum pressure to a mold cavity positioned between the at least first and second plates;

an enclosed ejector box that is configured to be vacuum sealed with respect to the second plate by vacuum pressure from the at least one vacuum source;

an ejector mechanism in the enclosed ejector box configured to eject molded amorphous alloy material from between the at least first and second plates, the ejector mechanism having an actuation portion configured to extend through an opening in the enclosed ejector box;

a seal configured to be positioned between each adjacent interfaces of: (a) the at least first plate and the second plate, (b) the second plate and the enclosed ejector box, and (c) the opening of the ejector box and the actuation portion of the ejector mechanism, and wherein the at least one vacuum source is configured to apply vacuum pressure from the at least one vacuum source to the at least first and second plates and the enclosed ejector box in a first direction using the first vacuum port and in a second direction to the at least first and second plates and the enclosed ejector box using the second vacuum port.

14. The mold according to claim 13, further comprising a vacuum release valve connected to the at least one vacuum port, and wherein the valve is configured to release vacuum pressure applied to at least the mold cavity.

15. The mold according to claim 13, wherein the ejector mechanism comprises an ejector plate connected to the actuation portion, and wherein the actuation portion is configured to move the ejector plate within the enclosed ejector box to eject the molded amorphous alloy material.

16. The mold according to claim 15, wherein the ejector plate further comprises a plurality of ejector pins extending in a linear direction towards the second plate, and wherein the ejector pins are configured to eject the molded amorphous alloy material upon movement of the ejector plate.

17. The mold according to claim 15, wherein the ejector mechanism is configured to move in a horizontal direction with respect to the enclosed ejector box.

18. The mold according to claim 13, further comprising at least one support plate provided adjacent the at least first plate, the second plate and/or the ejector box and that is configured to assist in molding the amorphous alloy material and that is configured to be vacuum sealed to the at least first plate, the second plate, and/or the ejector box by vacuum pressure from the at least one vacuum source.

19. The mold according to claim 18, further comprising one or more seals provided between adjacent interfaces of the at least one support plate and the at least first plate, second plate, and/or ejector box.

20. The mold according to claim 13, wherein the injection system configured to inject melted amorphous alloy material in a horizontal direction.

21. The mold according to claim 13, wherein the second direction is different from the first direction.

22. The mold according to claim 13, wherein the second direction is perpendicular to the first direction.

23. A method of manufacturing a part of amorphous alloy material using a vacuum mold comprising:

obtaining at least a first plate and a second plate configured to mold amorphous alloy material therebetween so as to substantially eliminate exposure of the amorphous alloy material therebetween to oxygen and nitrogen, the at least first and the second plates configured to be positioned adjacent an enclosed ejector box with a plurality of seals between adjacent interfaces of the at least first plate, the second plate, and the enclosed ejector box and configured to be vacuum sealed by vacuum pressure from at least one vacuum source configured to apply vacuum pressure to the at least first and second plates and the enclosed ejector box;

applying a vacuum pressure to the at least first and second plates and the enclosed ejector box via at least a first vacuum port and a second vacuum port both in communication with the at least one vacuum source;

injecting molten amorphous alloy material into a cavity between the at least first and second plates to mold the part;

releasing the vacuum pressure applied to the at least first and second plates and the enclosed ejector box via the at least one vacuum port;

moving the at least first plate and the second plate relative to and away from each other;

actuating an ejector mechanism positioned within the enclosed ejector box by moving an actuation portion extending through an opening in the enclosed ejector box, and ejecting the molded part from between the at least first and second plates using the ejector mechanism, wherein applying a vacuum pressure to the at least first and second plates and the enclosed ejector box comprises applying vacuum pressure from the at least one vacuum source to the at least first and second plates and the enclosed ejector box in a first direction using the first vacuum port and in a second direction to the at least first and second plates and the enclosed ejector box using the second vacuum port.

24. The method according to claim 23, further comprising a seal between the opening in the enclosed ejector box and the actuation portion of the ejector mechanism.

25. The method according to claim 24, wherein actuating of the ejector mechanism comprises moving the ejector mechanism in a horizontal direction with respect to the enclosed ejector box.

26. The method according to claim 23, wherein the ejector mechanism comprises an ejector plate connected to the actuation portion, and wherein the actuating comprises moving the ejector plate within the enclosed ejector box to eject the molded part.

27. The method according to claim 26, wherein the ejector plate further comprises a plurality of ejector pins extending in a linear direction, and wherein the ejecting comprises the ejector pins being moved in a linear direction to eject the molded part upon moving the ejector plate.

28. The method according to claim 23, wherein the second direction is different from the first direction.

29. The method according to claim 23, wherein the second direction is perpendicular to the first direction.

30. A vacuum mold comprising:

at least a first plate and a second plate configured to mold amorphous alloy material therebetween so as to substantially eliminate exposure of the amorphous alloy material therebetween to oxygen and nitrogen;

an enclosed ejector box positioned adjacent the at least first and the second plates that is configured to be vacuum sealed by vacuum pressure from at least one vacuum source;

at least one vacuum port in communication with the at least one vacuum source that is configured to apply vacuum pressure to the at least first and second plates and the enclosed ejector box;

an ejector mechanism in the enclosed ejector box configured to eject molded amorphous alloy material from between the at least first and second plates, the ejector mechanism comprising an actuation portion extending through a base plate of the enclosed ejector box, wherein the actuation portion at least partially extends outside of the enclosed ejector box; and a plurality of seals configured to be positioned between adjacent interfaces of the at least first plate, the second plate, and the enclosed ejector box, at least one of the seals provided at an interface between the actuation portion of the ejector mechanism and the base plate of the enclosed ejector box to vacuum seal the enclosed ejector box.

31. The mold according to claim 30, wherein the actuation portion extending outside of the base plate is outside an area within the ejector box that is vacuum sealed.

32. The mold according to claim 30, further comprising a seal positioned between adjacent surfaces of the second plate and the enclosed ejector box during application of the vacuum pressure.

33. The mold according to claim 30, wherein the base plate of the ejector box is spaced from the second plate such that an area is formed therebetween, and wherein the area is configured to be vacuum sealed by vacuum pressure.

34. The mold according to claim 30, wherein the ejector box further comprises one or more side plates extending between the base plate and the second plate.

* * * * *